US010113783B2

(12) United States Patent
Takagi

(10) Patent No.: US 10,113,783 B2
(45) Date of Patent: Oct. 30, 2018

(54) AIR CONDITIONING MACHINE

(71) Applicant: DAIKIN INDUSTRIES, LTD., Osaka-shi, Osaka (JP)

(72) Inventor: Motoki Takagi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/576,207

(22) PCT Filed: Jun. 29, 2016

(86) PCT No.: PCT/JP2016/069351
§ 371 (c)(1),
(2) Date: Nov. 21, 2017

(87) PCT Pub. No.: WO2017/010294
PCT Pub. Date: Jan. 19, 2017

(65) Prior Publication Data

US 2018/0142931 A1 May 24, 2018

(30) Foreign Application Priority Data

Jul. 14, 2015 (JP) ..... 2015-140632
Jun. 27, 2016 (JP) ..... 2016-126365

(51) Int. Cl.
*F25B 49/02* (2006.01)
*F25B 1/04* (2006.01)
(Continued)

(52) U.S. Cl.
CPC ..... *F25B 49/022* (2013.01); *F24F 11/36* (2018.01); *F25B 1/04* (2013.01); *F25B 9/004* (2013.01);
(Continued)

(58) Field of Classification Search
CPC ..... F25B 49/022; F25B 1/04; F25B 9/004; F25B 49/00
See application file for complete search history.

(56) References Cited

U.S. PATENT DOCUMENTS

2012/0266615 A1* 10/2012 Coussey ..... B64D 13/08 62/80
2013/0213068 A1* 8/2013 Goel ..... F25B 49/005 62/129

FOREIGN PATENT DOCUMENTS

JP 9-264641 A 10/1997
JP 2002-228281 A 8/2002
(Continued)

OTHER PUBLICATIONS

International Search Report for PCT/JP2016/069351 dated Sep. 20, 2016.

*Primary Examiner* — Elizabeth J Martin
(74) *Attorney, Agent, or Firm* — Birch, Stewart, Kolasch & Birch, LLP

(57) ABSTRACT

An air conditioning machine is provided by which refrigerant collected into an outdoor heat exchanger is suppressed from counter-flowing through a discharge hole of a compressor toward a side of an indoor heat exchanger after the end of a pump down operation. The air conditioning machine includes a refrigerant circuit, a refrigerant leakage sensor that senses leakage of the flammable refrigerant from the refrigerant circuit, and a control unit that carries out a pump down operation for accumulating the flammable refrigerant in the outdoor heat exchanger when the leakage of the flammable refrigerant is sensed. At the end of the pump down operation, the pump down operation control unit controls the compressor so that the compression member stops at a position where the compression member
(Continued)

overlaps at least a portion of the discharge hole when viewed in an axial direction of the cylinder chamber.

7 Claims, 16 Drawing Sheets

(51) Int. Cl.

| | |
|---|---|
| ***F25B 9/00*** | (2006.01) |
| ***F25B 13/00*** | (2006.01) |
| ***F25B 41/04*** | (2006.01) |
| ***F24F 11/36*** | (2018.01) |
| *F25B 49/00* | (2006.01) |

(52) U.S. Cl.

CPC ..... *F25B 13/00* (2013.01); *F25B 41/04* (2013.01); *F25B 49/02* (2013.01); *F25B 49/005* (2013.01); *F25B 2400/12* (2013.01); *F25B 2500/222* (2013.01); *F25B 2600/2519* (2013.01)

(56) References Cited

FOREIGN PATENT DOCUMENTS

| | | | |
|---|---|---|---|
| JP | 2004-215331 | A | 7/2004 |
| JP | 2013-213469 | A | 10/2013 |

* cited by examiner

AIR CONDITIONING MACHINE

TECHNICAL FIELD

The present invention relates to an air conditioning machine.

BACKGROUND ART

A conventional air conditioning machine is disclosed in JP 2002-228281 A (PTL 1). The air conditioning machine includes a refrigerant circuit in which a compressor, a four-way switching valve, an outdoor heat exchanger, an on-off valve, and an indoor heat exchanger are circularly connected and a gas detector which detects leakage of a refrigerant. Once the gas sensor senses the leakage of the refrigerant, a pump down operation is carried out.

When the pump down operation is carried out, the compressor is operated with the four-way switching valve switched into a cooling operation side and with the on-off valve closed. Thus the refrigerant can be collected into the outdoor heat exchanger.

CITATION LIST

Patent Literature

PTL1: JP 2002-228281 A

SUMMARY OF INVENTION

Technical Problem

The conventional air conditioning machine has a problem in that, even though the refrigerant is collected into the outdoor heat exchanger by the pump down operation, the refrigerant collected into the outdoor heat exchanger counter-flows through a discharge hole of the compressor toward a side of the indoor heat exchanger in the refrigerant circuit after the pump down operation is ended.

An object of the invention is, therefore, to provide an air conditioning machine by which a refrigerant collected into an outdoor heat exchanger can be suppressed from counter-flowing through a discharge hole of a compressor toward a side of an indoor heat exchanger in a refrigerant circuit after a pump down operation is ended.

Solution to Problem

In order to solve the problem, an air conditioning machine of the invention comprises:

a refrigerant circuit in which a compressor, a four-way switching valve, an indoor heat exchanger, a pressure reducing mechanism, and an outdoor heat exchanger are circularly connected;

a refrigerant leakage sensing unit that senses leakage of a flammable refrigerant from the refrigerant circuit; and a pump down operation control unit that carries out a pump down operation for accumulating the flammable refrigerant in the outdoor heat exchanger when the refrigerant leakage sensing unit senses the leakage of the flammable refrigerant, the compressor including:

a cylinder chamber;

a compression member that is placed in the cylinder chamber and that compresses the flammable refrigerant; and a discharge hole through which the flammable refrigerant compressed in the cylinder chamber is discharged, wherein the pump down operation control unit controls the compressor so that the compression member stops at a position where the compression member overlaps at least a portion of the discharge hole when viewed in an axial direction of the cylinder chamber, at an end of the pump down operation.

According to an above configuration, the pump down operation control unit controls the compressor so that the compression member stops at the position where the compression member overlaps at least the portion of the discharge hole when viewed in the axial direction of the cylinder chamber, at the end of the pump down operation. When the flammable refrigerant flows through the discharge hole after the end of the pump down operation, therefore, the compression member resists flow of the flammable refrigerant, so that an amount of the flammable refrigerant which passes through the discharge hole can be reduced. Consequently, the flammable refrigerant collected into the outdoor heat exchanger can be suppressed from counter-flowing through the discharge hole toward a side of the indoor heat exchanger in the refrigerant circuit.

In an embodiment, the air conditioning machine further comprises a position detection unit detecting a position of the compression member in the cylinder chamber.

According to the embodiment, the position detection unit detects the position of the compression member in the cylinder chamber. Accordingly, the pump down operation control unit is capable of reliably stopping the compression member at the position where the compression member overlaps the discharge hole when viewed in the axial direction of the cylinder chamber, at the end of the pump down operation, based on the detected position of the compression member.

In an embodiment, a first on-off valve is connected between the indoor heat exchanger and the pressure reducing mechanism.

According to the embodiment, the first on-off valve is closed after a lapse of a specified period of time from a start of the pump down operation, so that the flammable refrigerant can be confined in the outdoor heat exchanger and the compressor.

In an embodiment, the first on-off valve is an automatic valve.

According to the embodiment, in which the first on-off valve is the automatic valve, the automatic valve can automatically be closed after the lapse of the specified period of time from the start of the pump down operation and thus satisfactory controllability can be attained.

In an embodiment, the automatic valve is a solenoid valve or a motor-operated valve.

In the embodiment, the automatic valve, which is the solenoid valve or the motor-operated valve, is versatile and inexpensive.

In an embodiment, the pressure reducing mechanism is a fully closable motor-operated valve.

According to the embodiment, in which the pressure reducing mechanism is the fully closable motor-operated valve, the fully closable motor-operated valve can totally be closed after the lapse of the specified period of time from the start of the pump down operation, so that the flammable refrigerant can be confined in the outdoor heat exchanger and the compressor.

An air conditioning machine of the invention comprises:

a refrigerant circuit in which a compressor, a four-way switching valve, an outdoor heat exchanger, a pressure reducing mechanism, a first closing valve, an indoor heat exchanger, and a second closing valve are circularly connected;

a refrigerant leakage sensing unit that senses leakage of a flammable refrigerant from the refrigerant circuit; and a pump down operation control unit that carries out a pump down operation for accumulating the flammable refrigerant in the outdoor heat exchanger when the refrigerant leakage sensing unit senses the leakage of the flammable refrigerant, the compressor including:

a cylinder chamber;

a compression member that is placed in the cylinder chamber and that compresses the flammable refrigerant; and a discharge hole through which the flammable refrigerant compressed in the cylinder chamber is discharged, the air conditioning machine characterized in that the pump down operation control unit controls the compressor so that the compression member stops at a position where the compression member overlaps at least a portion of the discharge hole when viewed in an axial direction of the cylinder chamber at an end of the pump down operation.

According to an above configuration, the pump down operation control unit controls the compressor so that the compression member stops at the position where the compression member overlaps at least the portion of the discharge hole when viewed in the axial direction of the cylinder chamber at the end of the pump down operation. When the flammable refrigerant flows through the discharge hole after the end of the pump down operation, therefore, the compression member resists flow of the flammable refrigerant, so that an amount of the flammable refrigerant which passes through the discharge hole can be reduced. Consequently, the flammable refrigerant collected into the outdoor heat exchanger can be suppressed from counter-flowing through the discharge hole toward a side of the indoor heat exchanger in the refrigerant circuit.

In an embodiment, the air conditioning machine further comprises a position detection unit detecting a position of the compression member in the cylinder chamber.

According to the embodiment, the position detection unit detects the position of the compression member in the cylinder chamber. Accordingly, the pump down operation control unit is capable of reliably stopping the compression member at the position where the compression member overlaps the discharge hole when viewed in the axial direction of the cylinder chambers, at the end of the pump down operation, based on the detected position of the compression member.

Advantageous Effects of Invention

According to the air conditioning machine of the invention, the compression member is stopped at the position where the compression member overlaps the discharge hole when viewed in the axial direction of the cylinder chamber at the end of the pump down operation and thus the refrigerant collected into the outdoor heat exchanger can be suppressed from counter-flowing through the discharge hole of the compressor toward the side of the indoor heat exchanger in the refrigerant circuit after the end of the pump down operation.

DESCRIPTION OF EMBODIMENTS

Figure 1:
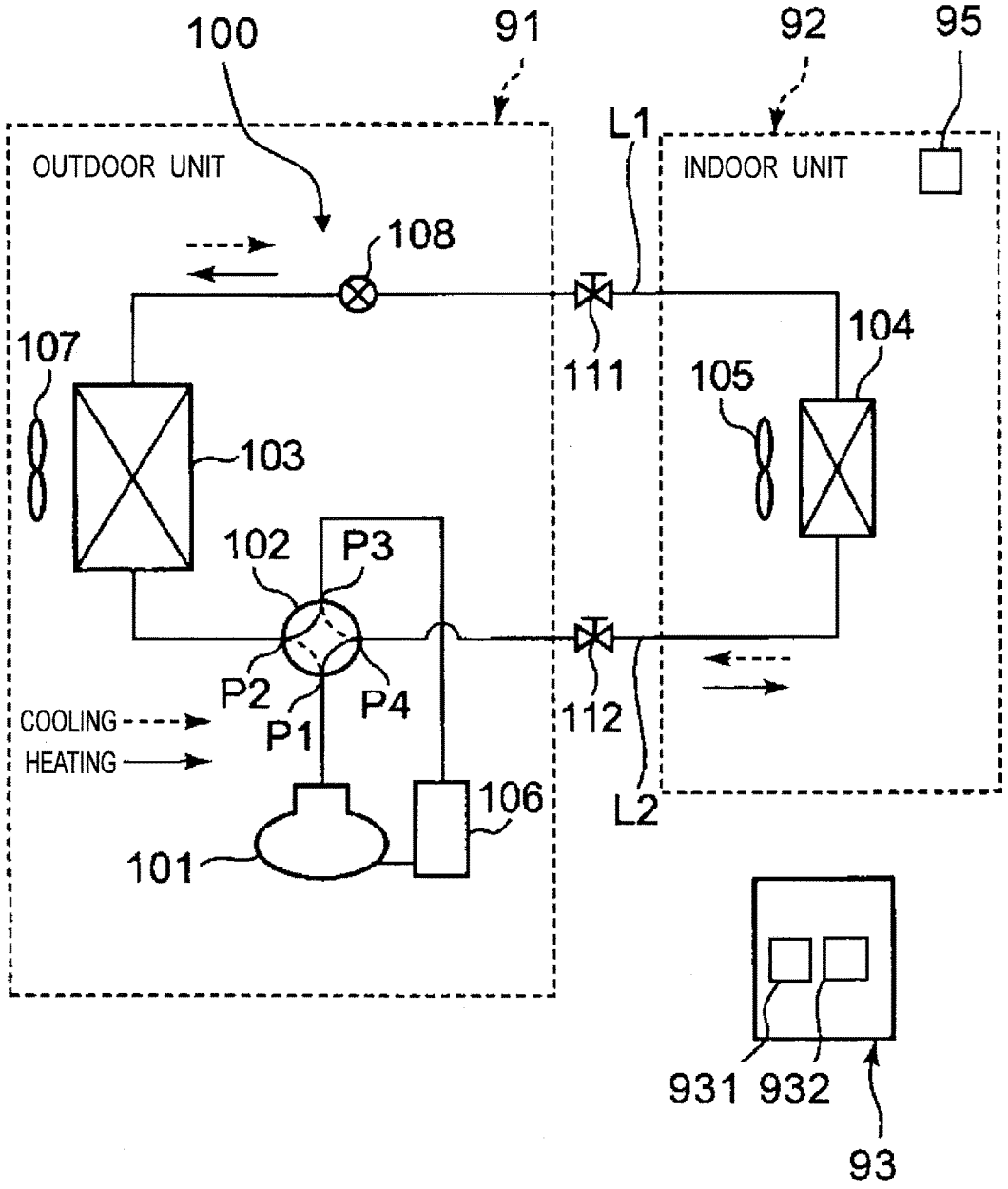
FIG. 1 is a schematic configuration illustrating an air conditioning machine in accordance with a first embodiment of the invention.

Hereinbelow, the invention will be described in detail with reference to embodiments illustrated in the drawings.

First Embodiment

FIG. 1 is a configuration illustrating an air conditioning machine in accordance with a first embodiment of the invention. As illustrated in FIG. 1, the air conditioning machine includes an outdoor unit 91, an indoor unit 92 connected to the outdoor unit 91, a controller 93, and a refrigerant leakage sensing unit 95. The outdoor unit 91 and the indoor unit 92 are connected through a first pipe L1 and a second pipe L2.

The outdoor unit 91 includes a compressor 101, a four-way switching valve 102, an outdoor heat exchanger 103, an expansion valve 108, an outdoor fan 107, and an accumulator 106. The expansion valve 108 is an example of the pressure reducing mechanism.

A first port P1 of the four-way switching valve 102 is connected to a discharge side of the compressor 101. One end of the outdoor heat exchanger 103 is connected to a second port P2 of the four-way switching valve 102. One end of the expansion valve 108 is connected to the other end of the outdoor heat exchanger 103. One end of the accumulator 106 is connected to a suction side of the compressor 101. The other end of the accumulator 106 is connected to a third port P3 of the four-way switching valve 102.

The indoor unit 92 includes an indoor heat exchanger 104 and an indoor fan 105. The other end of the expansion valve 108 is connected to one end of the indoor heat exchanger 104. A fourth port P4 of the four-way switching valve 102 is connected to the other end of the indoor heat exchanger 104.

The first pipe L1 is placed between the expansion valve 108 and the indoor heat exchanger 104 and the second pipe L2 is placed between the indoor heat exchanger 104 and the four-way switching valve 102. A first closing valve 111 is provided in the first pipe L1 and a second closing valve 112 is provided in the second pipe L2. The first and second closing valves 111 and 112 are stop valves or ball valves, for instance.

The compressor 101, the four-way switching valve 102, the outdoor heat exchanger 103, the expansion valve 108, and the indoor heat exchanger 104 are circularly connected so as to configure a refrigerant circuit (heat pump) 100. An operation of the compressor 101 causes a flammable refrigerant (a single refrigerant made of R32 or mixed refrigerants made primarily of R32, for instance) to circulate through the refrigerant circuit 100. The outdoor heat exchanger 103 performs heat exchange between outdoor air and the flammable refrigerant by the outdoor fan 107. The indoor heat exchanger 104 performs heat exchange between indoor air and the flammable refrigerant by the indoor fan 105.

The refrigerant leakage sensing unit 95 senses leakage of the flammable refrigerant from the refrigerant circuit 100. The refrigerant leakage sensing unit 95 is provided inside the indoor unit 92, for instance.

The controller 93 includes an operation control unit 931 and a position detection unit 932. The operation control unit 931 has a cooling operation mode, a heating operation mode, and a pump down operation mode. The cooling operation mode and the heating operation mode are effected when selected by a user or the like. The pump down operation mode is effected for accumulation of the flammable refrigerant in the outdoor heat exchanger 103 when the refrigerant leakage sensing unit 95 senses the leakage of the flammable refrigerant from the refrigerant circuit 100. The operation control unit 931 is an example of the pump down operation control unit.

In the cooling operation mode, a cooling operation is carried out. That is, the four-way switching valve 102 is switched to a position illustrated by dashed lines in FIG. 1 and the operation of the compressor 101 is started. As illustrated by arrows of dashed lines in FIG. 1, the flammable refrigerant that is discharged from the compressor 101 and that is in gas phase with a high temperature and a high pressure flows through the outdoor heat exchanger 103 and the expansion valve 108 and becomes the flammable refrigerant in liquid phase, which undergoes heat exchange with the indoor air in the indoor heat exchanger 104. Thus the indoor air to be blown off from the indoor heat exchanger 104 is cooled. In this operation, the flammable refrigerant in liquid phase flows through the first closing valve 111 and the flammable refrigerant in gas phase flows through the second closing valve 112.

In the heating operation mode, a heating operation is carried out. That is, the four-way switching valve 102 is switched to a position illustrated by solid lines in FIG. 1 and the operation of the compressor 101 is started. The flammable refrigerant that is discharged from the compressor 101 and that is in gas phase with a high temperature and a high pressure flows as illustrated by arrows of solid lines in FIG. 1 and undergoes heat exchange with the indoor air in the indoor heat exchanger 104. Thus the indoor air to be blown off from the indoor heat exchanger 104 is heated. In this operation, the flammable refrigerant in gas phase flows through the first closing valve 111 and the flammable refrigerant in liquid phase flows through the second closing valve 112.

In the pump down operation mode, the compressor 101, the first closing valve 111, the second closing valve 112, and the four-way switching valve 102 are controlled so that the pump down operation is carried out. Specifically, the cooling operation is forcibly started and a liquid side valve (the first closing valve 111) through which the flammable refrigerant in liquid phase flows in the cooling operation is automatically closed after a lapse of a specified period of time. Furthermore, a gas side valve (the second closing valve 112) through which the refrigerant in gas phase flows in the cooling operation is automatically closed after a lapse of a specified period of time. Thus the flammable refrigerant can be confined in the outdoor heat exchanger 103, the compressor 101, and the like.

Figure 2:
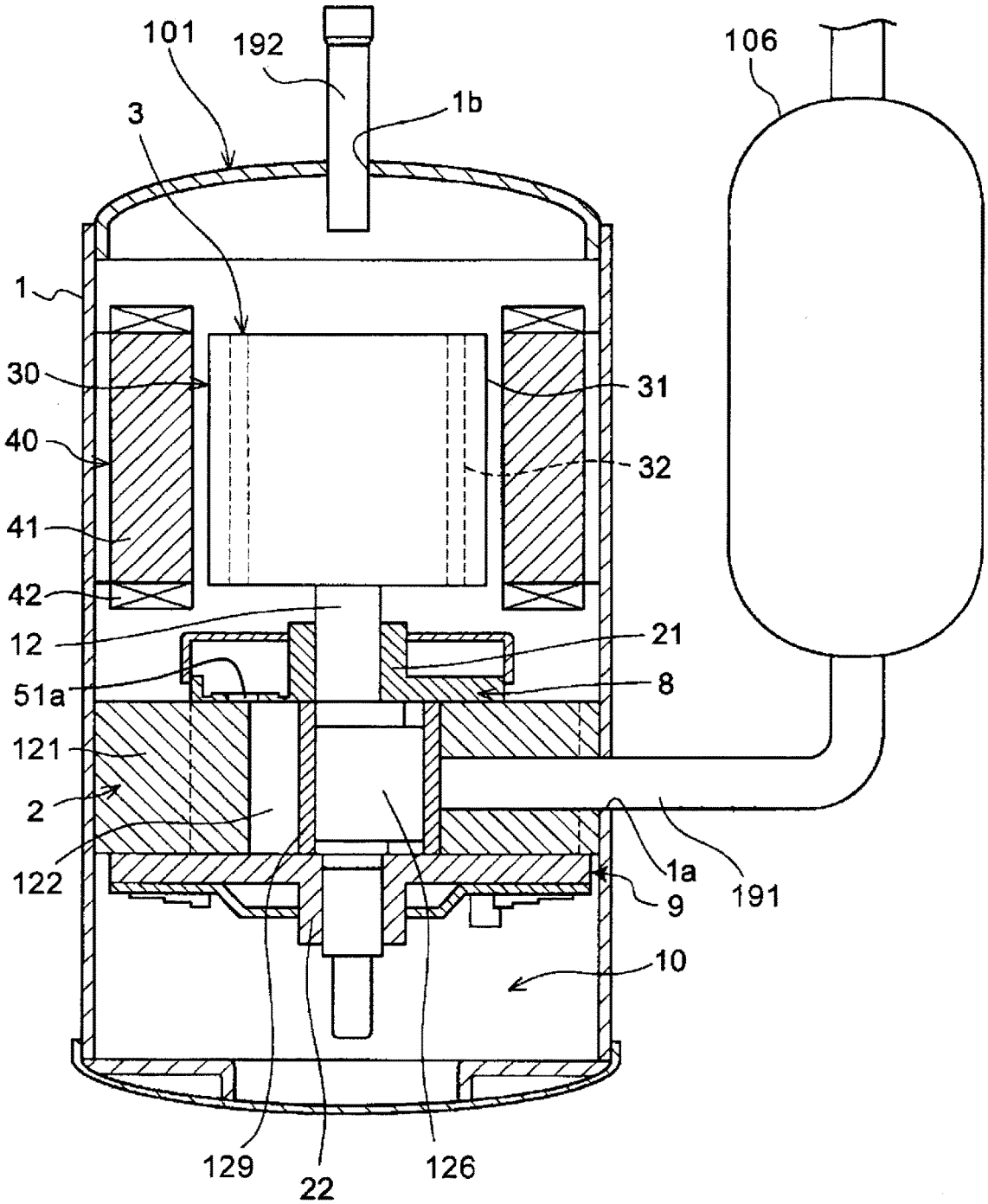
FIG. 2 is a longitudinal section of a compressor in the air conditioning machine.

As illustrated in FIG. 2, the compressor 101 includes a container body 1, a compression mechanism unit 2 that is placed in the container body 1, and a motor 3 that is placed in the container body 1 and that drives the compression mechanism unit 2. The compressor is a compressor that is of so-called vertical swing type.

A suction pipe 191 is connected to a suction port 1*a* on a lower side part of the container body 1 and a discharge pipe 192 is connected to a discharge port 1*b* on an upper part of the container body 1. The flammable refrigerant that is supplied from the suction pipe 191 is directly guided to a suction side of the compression mechanism unit 2.

The motor 3 is placed above the compression mechanism unit 2 and drives the compression mechanism unit 2 through a rotation shaft 12. The motor 3 is placed in a high-pressure region in the container body 1 that is to be filled with the high-pressure flammable refrigerant discharged from the compression mechanism unit 2.

An oil accumulation part 10 in which lubrication oil is accumulated is formed in a lower part in the container body 1. The lubrication oil moves from the oil accumulation part 10 through an oil passage (not illustrated) provided in the rotation shaft 12 to sliding parts such as bearings of the compression mechanism unit 2, the motor 3, and the like and lubricates the sliding parts. The lubrication oil is polyalkylene glycol oil (such as polyethylene glycol and polypropylene glycol), ethereal oil, ester oil, mineral oil, or the like.

The compression mechanism unit 2 includes a cylinder 121, and an upper end part 8 and a lower end part 9 that are respectively mounted on upper and lower opening ends of the cylinder 121. The suction pipe 191 is directly connected to the cylinder 121 and communicates with inside of the cylinder 121.

The rotation shaft 12 is inserted into the cylinder 121 through the upper end part 8 and the lower end part 9. The rotation shaft 12 is rotatably supported by a bearing 21 in the upper end part 8 and a bearing 22 in the lower end part 9.

An eccentric shaft part 126 is provided on the rotation shaft 12 in the cylinder 121 and a piston 129 is fitted onto the eccentric shaft part 126. A cylinder chamber 122 is formed between the piston 129 and the cylinder 121. The piston 129 rotates in an eccentric state or makes an orbital motion so as to change a volume of the cylinder chamber 122. The piston 129 is an example of the compression member that compresses the flammable refrigerant.

The motor 3 includes a rotor 30 and a stator 40. The rotor 30 is shaped like a cylinder and is fixed onto the rotation shaft 12. The stator 40 is placed so as to surround an outer peripheral side of the rotor 30. That is, the motor 3 is a motor of inner rotor type.

The rotor 30 includes a rotor core 31 and a plurality of magnets 32 that are axially embedded and circumferentially arranged in the rotor core 31. The stator 40 includes a stator core 41 that is in contact with an inner surface of the container body 1 and coils 42 wound around the stator core 41.

Passage of a current through the coils 42 generates an electromagnetic force that rotates the rotor 30 and rotation of the rotor 30 causes the piston 129 to make the orbital motion through medium of the rotation shaft 12 and to carry out a compression operation for compressing the flammable refrigerant in the cylinder chamber 122. Then the flammable refrigerant compressed in the cylinder chamber 122 is discharged to outside of the cylinder chamber 122 through a discharge hole 51*a* provided on the upper end part 8 of the compression mechanism unit 2.

The position detection unit 932 (see FIG. 1) detects a position of the rotor core 31 of the motor 3 based on the current, a voltage, and/or the like applied to the coils 42 of the motor 3 and detects a position of the piston 129 in the cylinder chamber 122 based on the position of the rotor core 31.

Subsequently, the compression operation of the cylinder 121 of the compression mechanism unit 2 will be described in accordance with FIGS. 3A through 3D. FIGS. 3A through 3D illustrate plan views of principal parts of the compression mechanism unit 2 of the compressor 101.

Figure 3A:
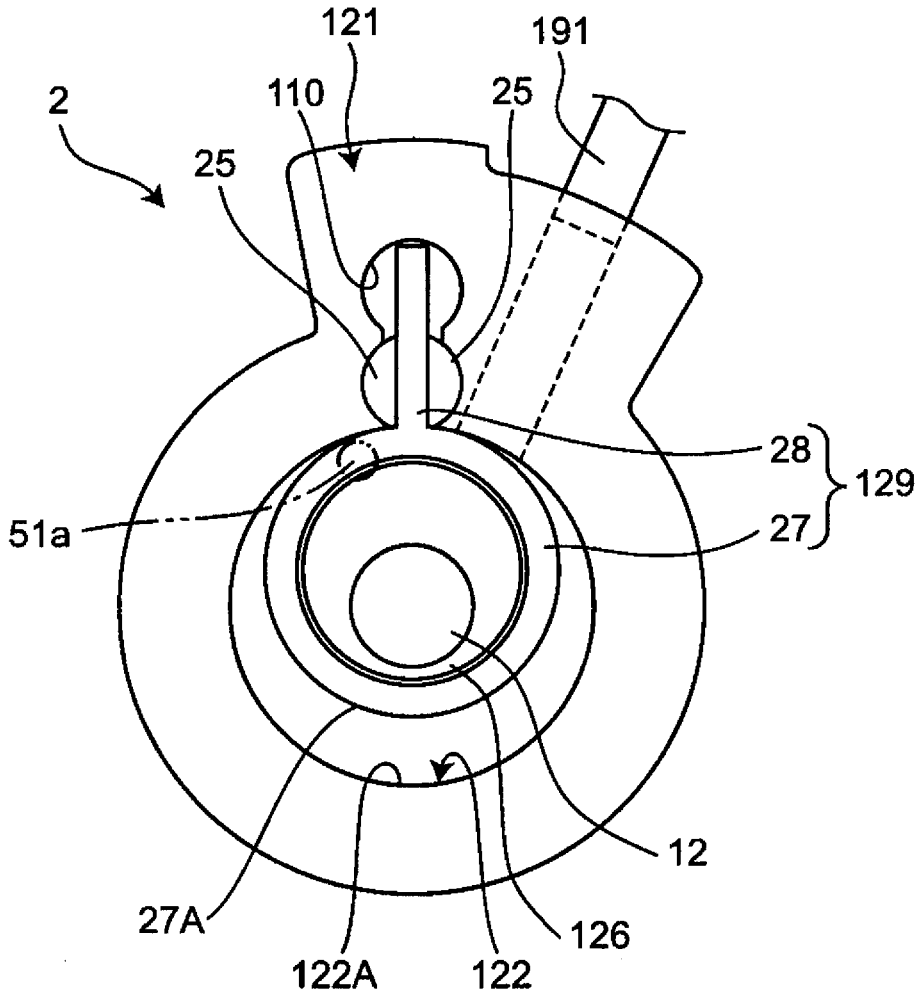
FIG. 3A is a plan view illustrating configurations and actions of principal parts of a compression mechanism of the compressor.

As illustrated in FIG. 3A, the piston 129 includes a roller 27 and a blade 28 fixed onto an outer peripheral surface of the roller 27. The roller 27 and the blade 28 are integrally provided.

Figure 3B:
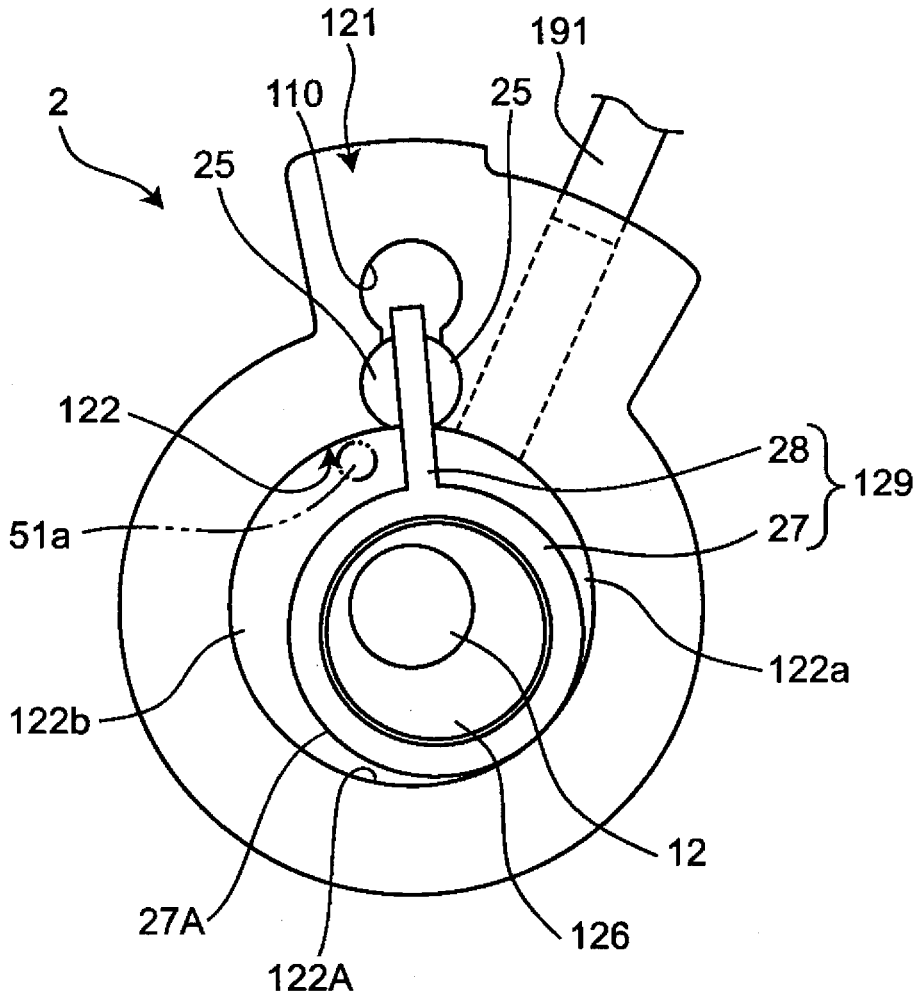
FIG. 3B is a plan view illustrating the configurations and the actions of the principal parts of the compression mechanism.
Figure 3C:
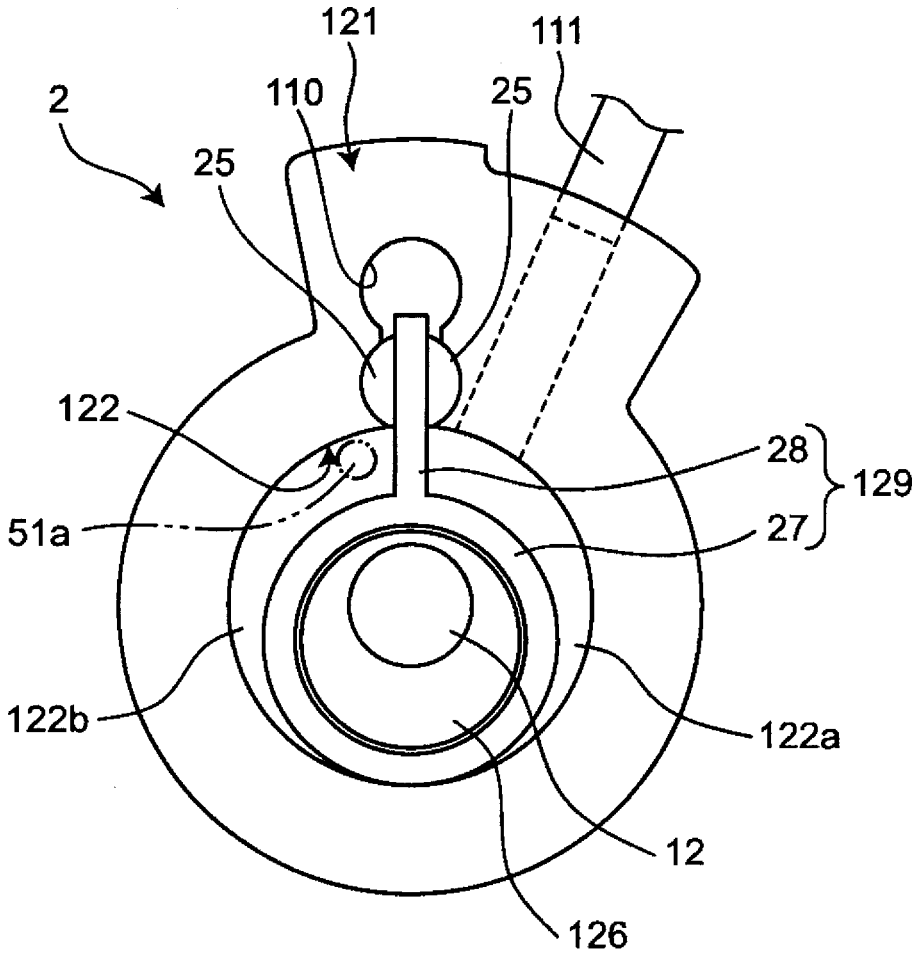
FIG. 3C is a plan view illustrating the configurations and the actions of the principal parts of the compression mechanism.
Figure 3D:
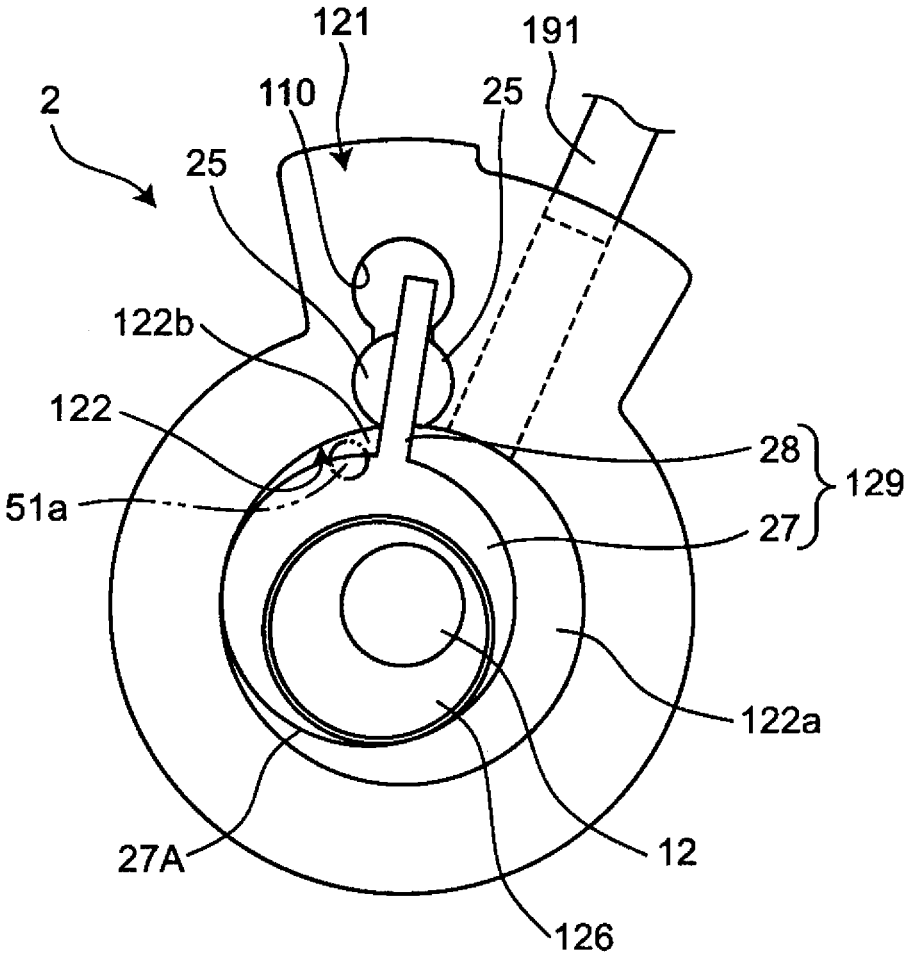
FIG. 3D is a plan view illustrating the configurations and the actions of the principal parts of the compression mechanism.

As illustrated in FIGS. 3B through 3D, inside of the cylinder chamber 122 is partitioned by the blade 28 of the piston 129. That is, the suction pipe 191 opens on an inner surface of the cylinder chamber 122 into a chamber on a right side of the blade 28 so that the chamber on the right side forms a suction chamber (low-pressure chamber) 122*a*. On the other hand, the discharge hole 51*a* opens on the inner surface of the cylinder chamber 122 into a chamber on a left side of the blade 28 so that the chamber on the left side forms a discharge chamber (high-pressure chamber) 22*b*.

A pair of semicylindrical bushes 25, 25 are in intimate contact with both side surfaces of the blade 28 so as to effect sealing. Lubrication between the blade 28 and the bushes 25, 25 is effected by the lubrication oil. The bushes 25, 25 rollably and reciprocatingly support the blade 28 by holding the blade 28 from both sides. The blade 28 comes into and goes out of a lubricated space 110 provided in the cylinder 121. The lubricated space 110 and the oil accumulation part 10 (illustrated in FIG. 2) communicate with each other through an oil feed pipe not illustrated.

As sequentially illustrated in FIGS. 3A through 3D, the eccentric shaft part 126 eccentrically rotates with the rotation shaft 12 clockwise in FIGS. 3A through 3D. Then the outer peripheral surface 27A of the roller 27 fitted onto the eccentric shaft part 126 makes an orbital motion that is clockwise in FIGS. 3A through 3D, while being in contact with the inner peripheral surface 122A of the cylinder chamber 122.

With the orbital motion of the roller 27 in the cylinder chamber 122, the blade 28 reciprocates with both the side surfaces of the blade 28 supported by the bushes 25, 25. Accordingly, the flammable refrigerant in a low-pressure gas state is sucked from the suction pipe 191 into the suction chamber 122*a* and is then compressed in the discharge chamber 122*b* so as to have a high pressure and the flammable refrigerant gas in a high-pressure gas state is thereafter discharged through the discharge hole 51*a*.

At an end of the pump down operation, as illustrated in FIG. 3A, the operation control unit 931 controls the compressor 101 so that the piston 129 stops at an overlapping position where the roller 27 of the piston 129 overlaps the entire discharge hole 51*a* when viewed in an axial direction of the cylinder chamber 122.

Then the operation control unit 931 controls the compressor 101 based on the position of the piston 129 detected by the position detection unit 932 so that the piston 129 stops at the overlapping position. As a result, the operation control unit 931 is capable of reliably stopping the piston 129 at the overlapping position.

According to the air conditioning machine having above configurations, the operation control unit 931 controls the compressor 101 so that the roller 27 of the piston 129 stops at the overlapping position at the end of the pump down operation. When the flammable refrigerant flows through the discharge hole 51*a* after the end of the pump down operation, therefore, the roller 27 of the piston 129 resists flow of the flammable refrigerant, so that an amount of the flammable refrigerant which passes through the discharge hole 51*a* can be reduced. Consequently, the flammable refrigerant collected into the outdoor heat exchanger 103 can be suppressed from counter-flowing through the discharge hole 51*a* toward a side of the indoor heat exchanger 104 in the refrigerant circuit 100.

Besides, even in case where a malfunction or the like makes it impossible to close the second closing valve 112, an amount of the flammable refrigerant which passes through the second closing valve 112 can be reduced.

Though the operation control unit 931 controls the compressor 101 so that the piston 129 stops at the overlapping position where the roller 27 of the piston 129 overlaps the entire discharge hole 51*a* when viewed in the axial direction of the cylinder chamber 122, there is no limitation to such an operation. For instance, as illustrated in FIG. 3D, the operation control unit may control the compressor 101 so that the piston 129 stops at a position where the roller 27 of the piston 129 overlaps a portion of the discharge hole 51*a* when viewed in the axial direction of the cylinder chamber 122.

Second Embodiment

FIGS. 4A through 4D illustrate plan views of principal parts of a compression mechanism unit 152 of a compressor in an air conditioning machine in accordance with a second embodiment of the invention. The compressor of the second embodiment differs from the first embodiment in that a piston 179 includes a roller 81 and a blade 82 which are separated so as to make relative motions. For the second embodiment, the same reference characters as those of the first embodiment denote the same configurations as those of the first embodiment and thus description thereon is omitted. The compressor is a compressor that is of so-called rotary type.

Figure 4A:
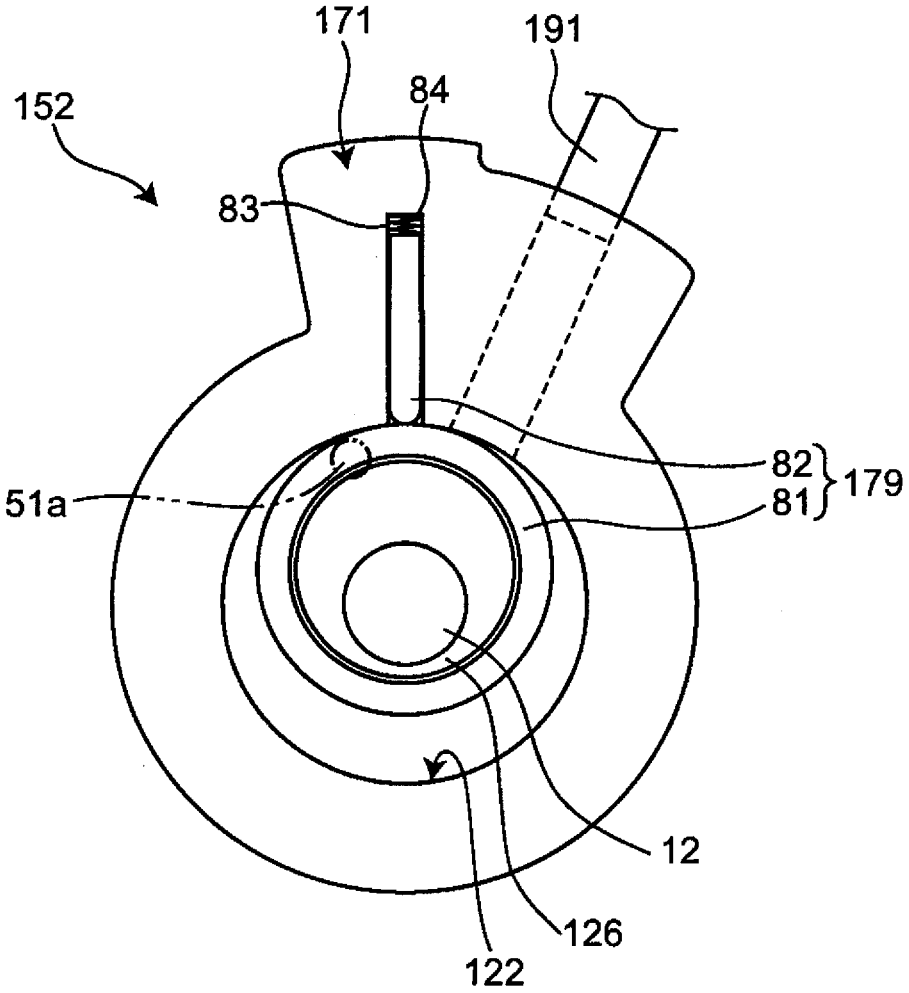
FIG. 4A is a plan view illustrating configurations and actions of principal parts of a compression mechanism of a compressor in an air conditioning machine in accordance with a second embodiment of the invention.
Figure 4B:
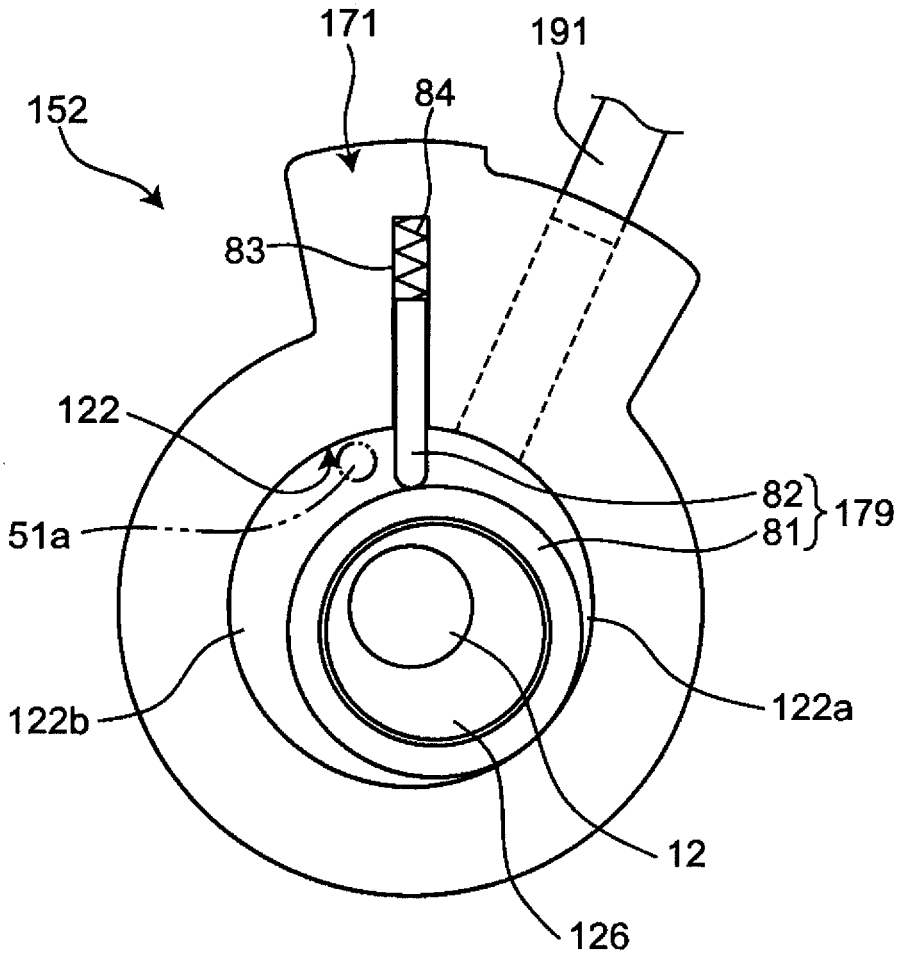
FIG. 4B is a plan view illustrating the configurations and the actions of the principal parts of the compression mechanism in the second embodiment.
Figure 4C:
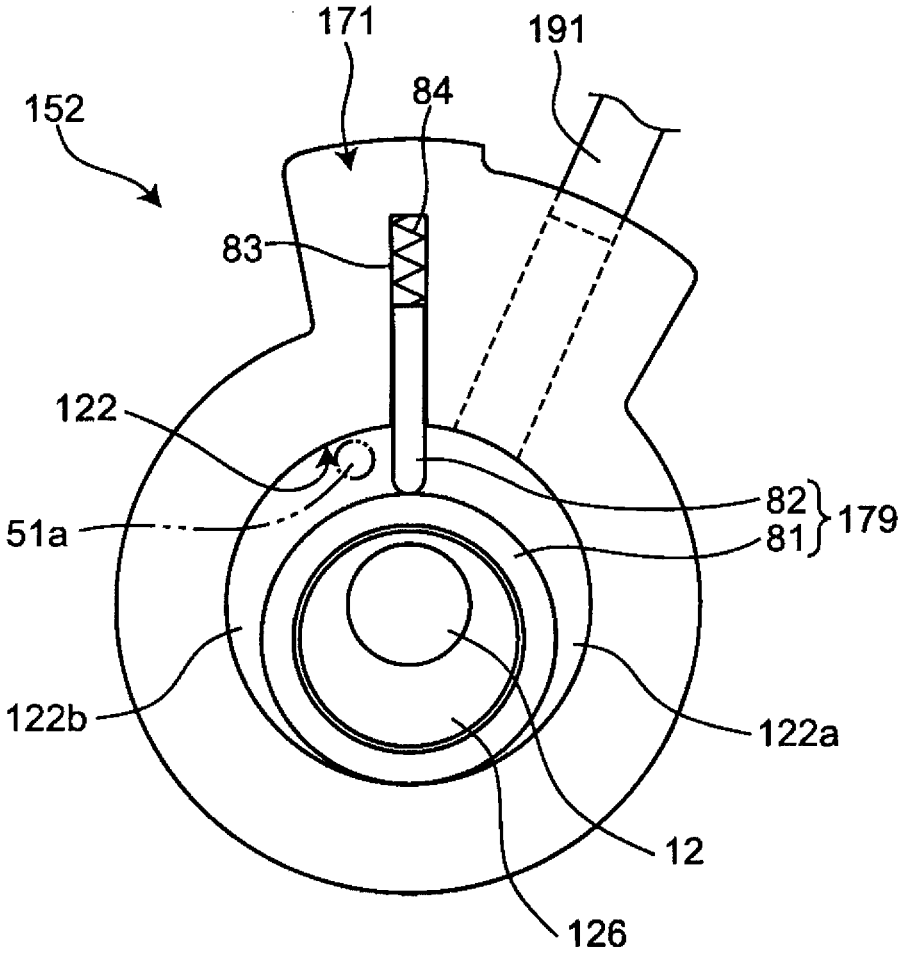
FIG. 4C is a plan view illustrating the configurations and the actions of the principal parts of the compression mechanism in the second embodiment.

As illustrated in FIG. 4A, the blade 82 extends vertically. A lower end part of the blade 82 is in contact with the roller 81 and an upper end part of the blade 82 is pressed downward in the drawing by a spring 84 installed in a blade housing chamber 83 provided in a cylinder 171. With movement of the roller 81, as illustrated in FIGS. 4A through 4D, the blade 82 vertically moves in and out between the cylinder chamber 122 and the blade housing chamber 83.

In this configuration as well, as with the first embodiment, the operation control unit 931 controls the compressor 101 so that the roller 81 of the piston 179 stops at the overlapping position at the end of the pump down operation. When the flammable refrigerant flows through the discharge hole 51*a* after the end of the pump down operation, therefore, the roller 81 of the piston 179 resists the flow of the flammable refrigerant, so that the amount of the flammable refrigerant which passes through the discharge hole 51*a* can be reduced. Consequently, the flammable refrigerant collected into the outdoor heat exchanger 103 can be suppressed from counter-flowing through the discharge hole 51*a* toward the side of the indoor heat exchanger 104 in the refrigerant circuit 100.

Figure 4D:
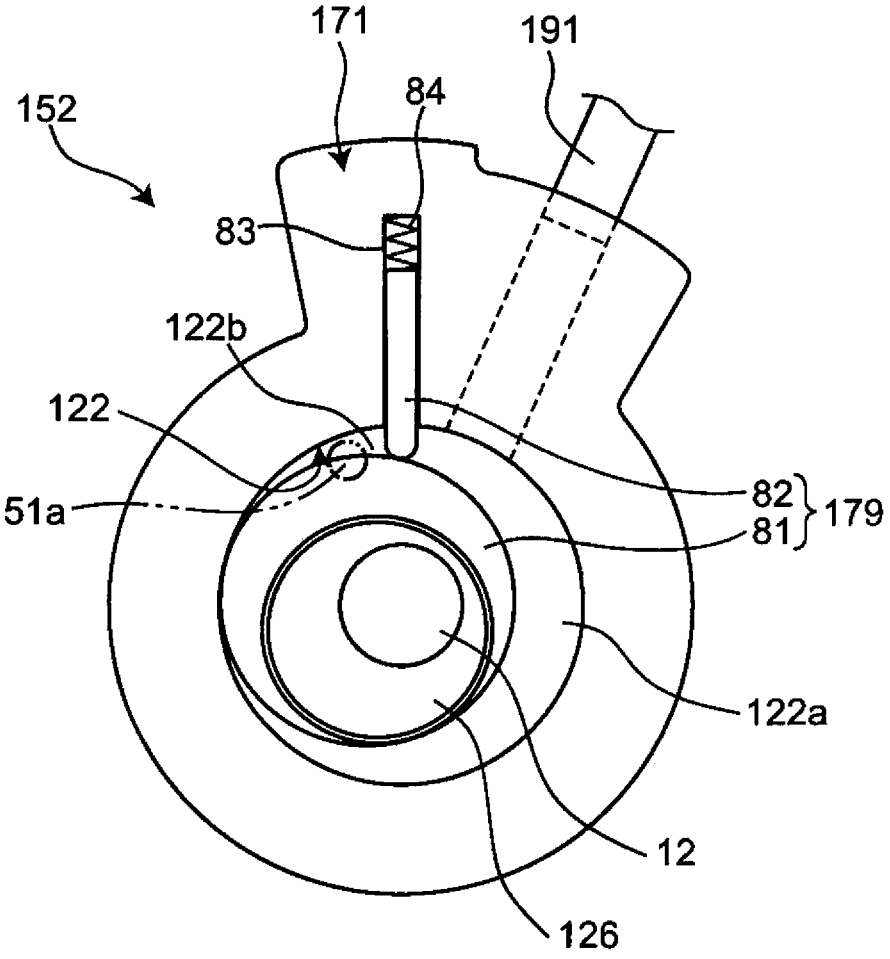
FIG. 4D is a plan view illustrating the configurations and the actions of the principal parts of the compression mechanism in the second embodiment.

Though the operation control unit 931 controls the compressor 101 so that the piston 179 stops at the overlapping position where the roller 81 of the piston 179 overlaps the entire discharge hole 51*a* when viewed in the axial direction of the cylinder chamber 122, there is no limitation to such an operation. For instance, as illustrated in FIG. 4D, the operation control unit may control the compressor 101 so that the piston 179 stops at a position in which the roller 81 of the piston 179 overlaps a portion of the discharge hole 51*a* when viewed in the axial direction of the cylinder chamber 122.

Third Embodiment

Figure 5:
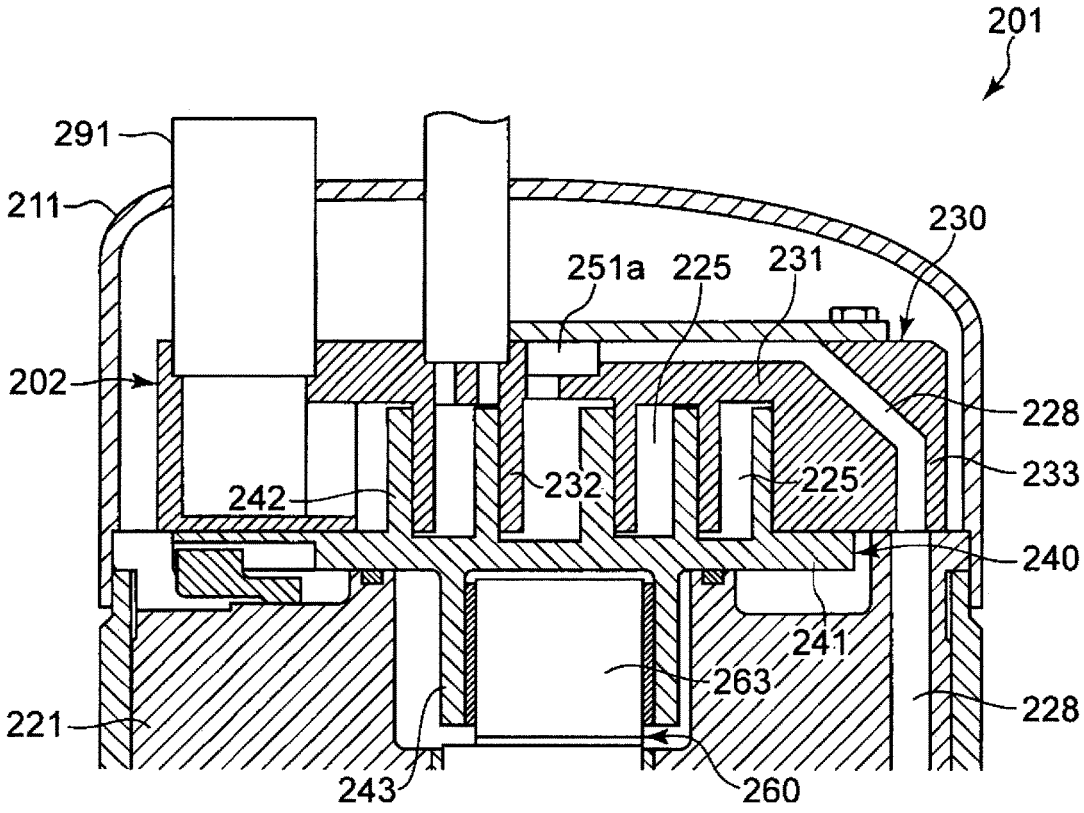
FIG. 5 is a longitudinal section illustrating principal parts of a compression mechanism of a compressor in an air conditioning machine in accordance with a third embodiment of the invention.

FIG. 5 illustrates a vertical section of principal parts of a compressor 201 in an air conditioning machine in accordance with a third embodiment of the invention. As illustrated in FIG. 5, the compressor 201 includes a closed container 211, a compression mechanism unit 202 that is placed in the closed container 211, and a motor that is placed in the closed container 211 and under the compression mechanism unit 202, that drives the compression mechanism unit 202 through a crankshaft 260, and that is not illustrated. The compressor is a compressor that is of so-called scroll type.

A suction pipe 291 is fixed to the closed container 211. The suction pipe 291 penetrates the closed container 211. When the compression mechanism unit 202 is driven by the motor through the crankshaft 260, the flammable refrigerant that is supplied from the suction pipe 291 is supplied into the compression mechanism unit 202 and is compressed.

The compression mechanism unit 202 includes a housing 221, a fixed scroll 230, and a movable scroll 240 that is made to overlap the fixed scroll 230 and that moves so as to be capable of making an orbital motion relative to the closed chamber 211.

The housing 221 is shaped like a thick disc. The housing 221 has an outer peripheral surface in contact with an inner peripheral surface of the closed chamber 211 and is fixed to the closed chamber 211. The crankshaft 260 penetrates a center part of the housing 221.

The fixed scroll 230 and the movable scroll 240 are laid on the housing 221. The fixed scroll 230 is fixed to the housing 221 by bolts or the like. By contrast, the movable scroll 240 is not fixed to the housing 221 but attached to the crankshaft 260.

The movable scroll 240 is a member into which a movable head part 241, a movable lap 242, and a cylindrical part 243 are integrally formed. The movable head part 241 is shaped like a disc. The movable lap 242 is shaped like a spiral wall and is provided so as to protrude upward from a front face (upper face in FIG. 5) of the movable head part 241. The cylindrical part 243 is shaped like a cylinder and is provided so as to protrude downward from a back face (lower face in FIG. 5) of the movable head part 241. An eccentric part 263 of the crankshaft 260 is fitted into the cylindrical part 243 so that the movable scroll 240 is made to swivel (make an orbital motion) by rotation of the crankshaft 260.

The fixed scroll 230 is a member in which a fixed head part 231 and a fixed lap 232 are integrally formed. The fixed head part 231 is shaped like a disc. The fixed lap 232 is shaped like a spiral wall and is provided so as to protrude downward from a front face (lower face in FIG. 5) of the fixed head part 231. The fixed head part 231 includes a part 233 that surrounds a periphery of the fixed lap 232. An inner peripheral surface of the part 233, together with the fixed lap 232, is in slide contact with the movable lap 242 and thereby forms cylinder chambers 225.

The suction pipe 291 is inserted into a vicinity of an outer periphery of the fixed head part 231. A discharge hole 251*a* is formed on the fixed head part 231. The discharge hole 251*a* is a throughhole formed in a vicinity of a center of the fixed head part 231 and penetrates the fixed head part 231 in a thickness direction thereof. On the front face of the fixed head part 231, the discharge hole 251*a* opens in a vicinity of an end part on an inner peripheral side of the fixed lap 232.

A discharge gas passage 228 is formed in the compression mechanism unit 202. The discharge gas passage 228 is a passage that is formed so as to extend across the housing 221 from within the fixed scroll 230. In the discharge gas passage 228, one end communicates with the discharge hole 251*a* and the other end opens on a bottom surface of the housing 221.

In the compression mechanism unit 202, the fixed scroll 230 and the movable scroll 240 are placed so that the front face of the fixed head part 231 and the front face of the movable head part 241 face each other and so that the fixed lap 232 and the movable lap 242 mesh with each other. In the compression mechanism unit 202, the fixed lap 232 and the movable lap 242 mesh with each other and the plurality of cylinder chambers 225 are thereby formed.

Upon energization of the motor, the movable scroll 240 is driven by the crankshaft 260 so as to swivel. By swivelling of the movable scroll 240, the flammable refrigerant in the refrigerant circuit 100 is sucked through the suction pipe 291 into the compression mechanism unit 202. When the movable scroll 240 further rotates in such a state, a suction process, a compression process, and a discharge process are sequentially carried out in the cylinder chambers 225. The flammable refrigerant compressed in the compression mechanism unit 202 is discharged from the discharge hole 251*a* through the discharge gas passage 228 to outside of the closed container 211. The movable scroll 240 is an example of the compression member that compresses the flammable refrigerant.

Subsequently, compression operation of the compression mechanism unit 202 will be described in accordance with FIGS. 6A through 6D. FIGS. 6A through 6D illustrate plan views of principal parts of the compression mechanism unit 202 of the compressor 201.

In the compression mechanism unit 202, as illustrated in FIGS. 6A through 6D, the fixed lap 232 and the movable lap 242 mesh with each other so that the plurality of crescent-shaped cylinder chambers 225 are formed in plan view.

Figure 6A:
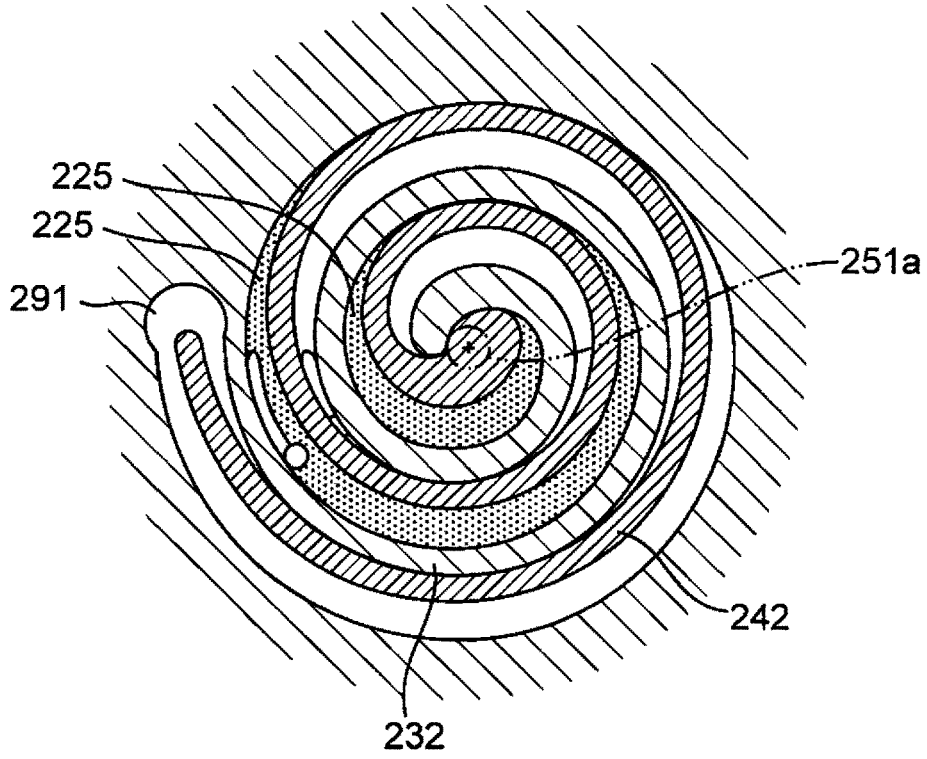
FIG. 6A is a cross section illustrating configurations and actions of the principal parts of the compression mechanism in the third embodiment.
Figure 6B:
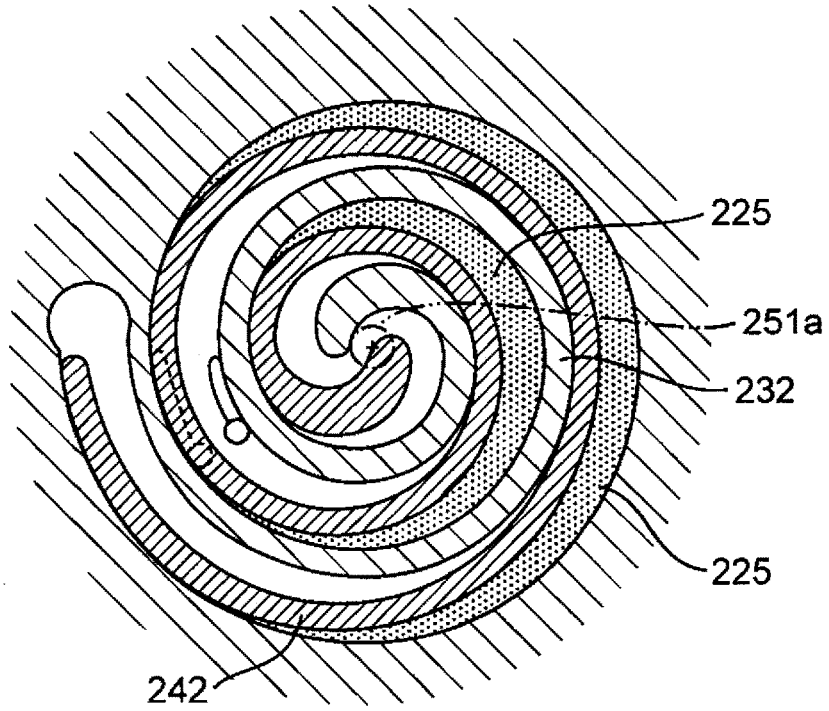
FIG. 6B is a cross section illustrating the configurations and the actions of the principal parts of the compression mechanism in the third embodiment.
Figure 6C:
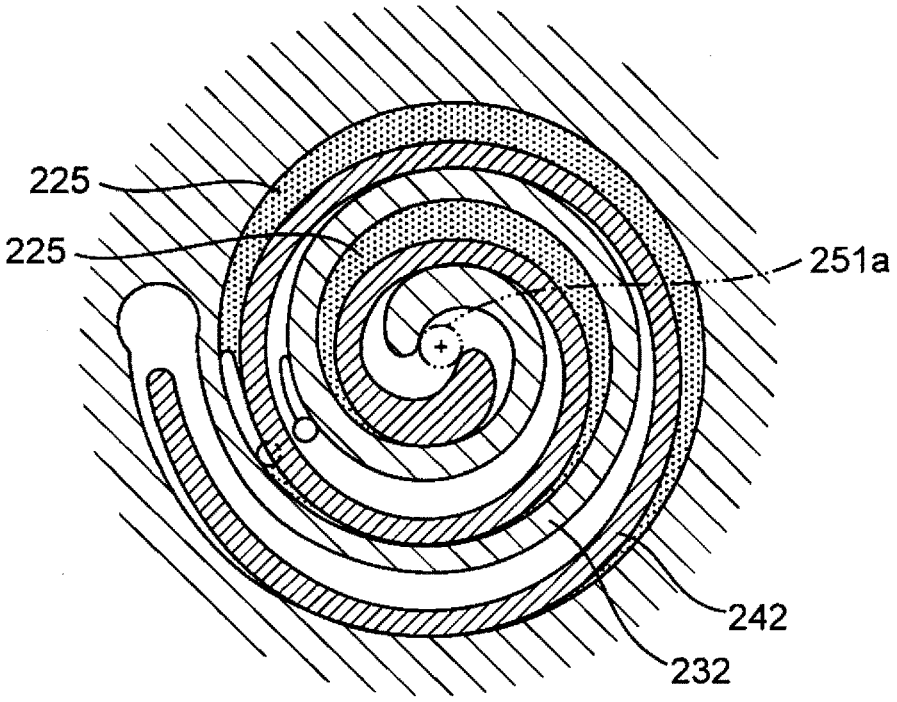
FIG. 6C is a cross section illustrating the configurations and the actions of the principal parts of the compression mechanism in the third embodiment.
Figure 6D:
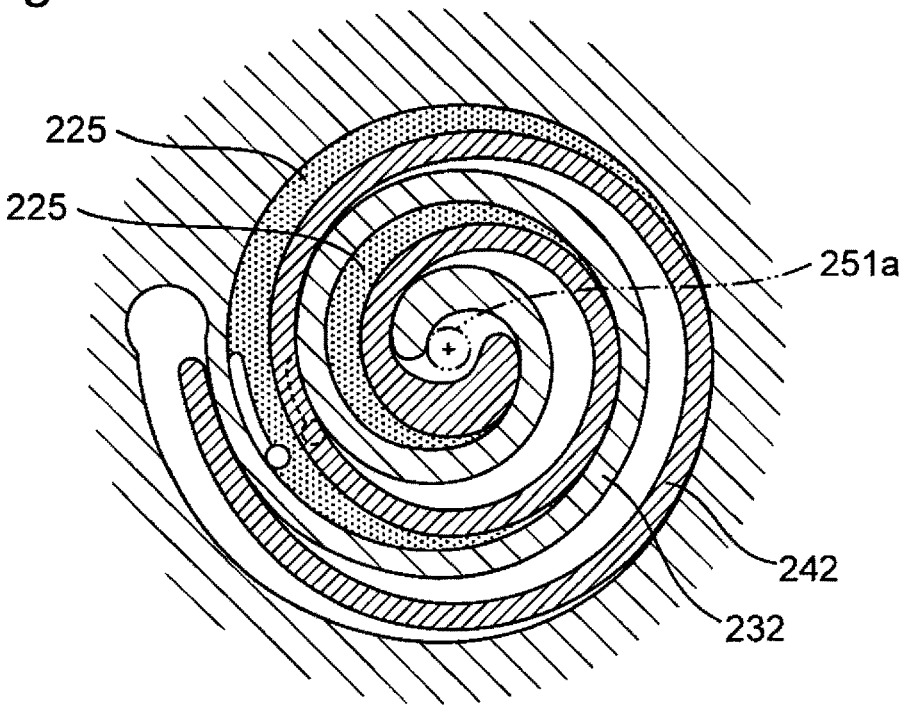
FIG. 6D is a cross section illustrating the configurations and the actions of the principal parts of the compression mechanism in the third embodiment.

With swivelling of the movable lap 242 in a state of FIG. 6A, the flammable refrigerant flows through the suction pipe 291 into between the fixed lap 232 and the movable lap 242 (suction process). When the movable lap 242 in a state of FIG. 6B further rotates in a sequence of FIGS. 6C, 6D, and 6A, volumes of the cylinder chambers 225 are decreased so that the flammable refrigerant is compressed (compression process). When the cylinder chambers 225 communicate with the discharge hole 251*a* after the movable lap 242 further rotates, the flammable refrigerant having a high pressure is discharged through the discharge hole 251*a* (discharge process).

At the end of the pump down operation, as illustrated in FIG. 6A, the operation control unit 931 controls the compressor 201 so that the movable lap 242 stops at an overlapping position where the movable lap 242 overlaps the entire discharge hole 251*a* when viewed in an axial direction of the cylinder chambers 225.

In this configuration as well, as with the first embodiment, the operation control unit 931 controls the compressor 201 so that the movable lap 242 of the movable scroll 240 stops at the overlapping position at the end of the pump down operation. After the end of the pump down operation, therefore, the movable lap 242 covers the discharge hole 251*a* so that an amount of the flammable refrigerant which passes through the discharge hole 251*a* can be reduced. Consequently, the flammable refrigerant collected into the outdoor heat exchanger 103 can be suppressed from counter-flowing through the discharge hole 251*a* toward the side of the indoor heat exchanger 104 in the refrigerant circuit 100.

Though the operation control unit 931 controls the compressor 201 so that the movable scroll 240 stops at the overlapping position where the movable lap 242 of the movable scroll 240 overlaps the entire discharge hole 251*a* when viewed in the axial direction of the cylinder chambers 225, there is no limitation to such an operation. For instance, the operation control unit may control the compressor so that the movable scroll 240 stops at a position where the movable lap of the movable scroll overlaps at least a portion of the discharge hole when viewed in the axial direction of the cylinder chambers.

Though the first and second closing valves 111 and 112 are automatically closed in the pump down operation in the first through third embodiments of the invention, the first and second closing valves may manually be closed without limitation to such a technique.

Though the pressure reducing mechanism is the expansion valve 108 in the first through third embodiments, the pressure reducing mechanism may be a capillary tube or the like, for instance, without limitation to such a configuration.

In the first through third embodiments, the position detection unit 932 detects the position of the rotor of the motor 3 based on the current, the voltage, and/or the like applied to the coils of the motor 3 and thereby detects the position of the piston 129, 179 or the movable scroll 240. Without limitation to such a technique, however, an encoder may be provided in the motor and a rotational position of the motor or the like may be detected based on output of the encoder, for instance. Instead of the position detection unit, a lock mechanism may be provided that nips and locks the piston or the movable scroll so that the piston or the movable scroll stops at the specified position at the end of the pump down operation, for instance.

Though the refrigerant leakage sensing unit 95 is provided inside the indoor unit 92 in the first through third embodiments, the refrigerant leakage sensing unit may be provided in a room in which the indoor unit is provided and may sense the flammable refrigerant having leaked into the room, without limitation to such a configuration.

Though the single refrigerant made of R32, which is slightly flammable, or the mixed refrigerants made primarily of R32 are used as the flammable refrigerant in the first through third embodiments, a flammable refrigerant such as propane, butane, and ammonia may be used, without limitation to such a configuration.

Fourth Embodiment

Figure 7:
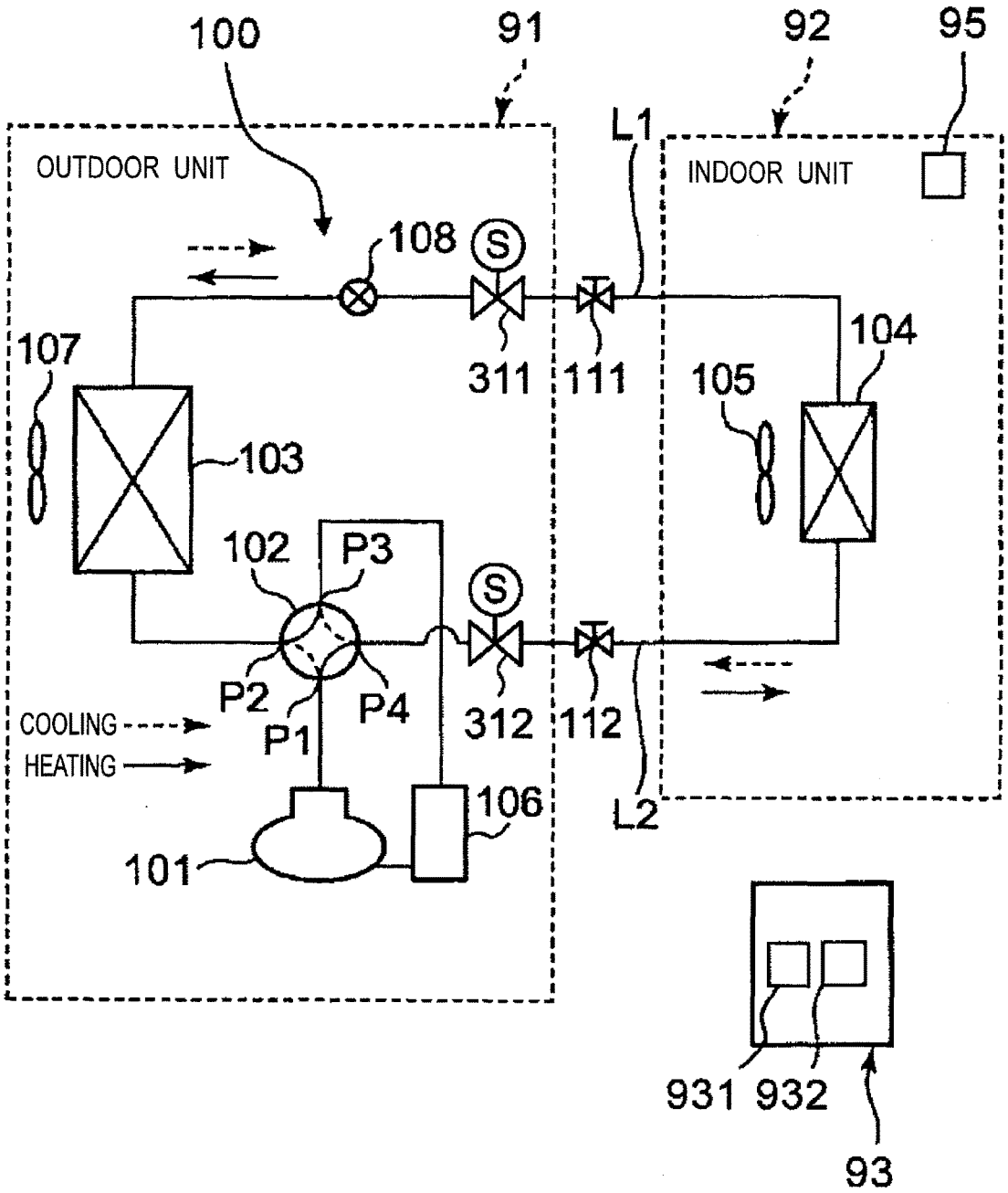
FIG. 7 is a schematic configuration illustrating an air conditioning machine in accordance with a fourth embodiment of the invention.

FIG. 7 is a schematic configuration illustrating an air conditioning machine in accordance with a fourth embodiment of the invention and is different from FIG. 1 for the first embodiment only in that solenoid valves 311 and 312 are provided. Components in FIG. 7 that are the same as the components of the first embodiment illustrated in FIG. 1 are provided with the same reference characters as those for the components in FIG. 1 and different components will be described below with description on configurations and actions of the same components omitted. FIGS. 2 and 3A through 3D for the first embodiment will be reused for the fourth embodiment.

Though the first and second closing valves 111 and 112 are used as an example of the on-off valves in the first embodiment illustrated in FIG. 1, the first and second solenoid valves 311 and 312 that open and close automatically are used as an example of the on-off valves, in the fourth embodiment, and the first and second closing valves 111 and 112 are used as on-off valves that are manually opened and closed for services such as repairing and inspection.

The first solenoid valve 311 is connected between the expansion valve 108 and the first closing valve 111 and the second solenoid valve 312 is connected between the four-way switching valve 102 and the second closing valve 112.

When the refrigerant leakage sensing unit 95 senses leakage of the flammable refrigerant from the refrigerant circuit 100 in the air conditioning machine having above configurations, the operation control unit 931 as the pump down operation control unit in the controller carries out the pump down operation mode for accumulating the flammable refrigerant in the outdoor heat exchanger 103 and the compressor 101.

In the pump down operation mode, the compressor 101, the first solenoid valve 311, the second solenoid valve 312, and the four-way switching valve 102 are controlled by the operation control unit 931 so that the cooling operation is forcibly started, so that the first solenoid valve 311 through which the flammable refrigerant in liquid phase flows in the cooling operation is automatically closed after a lapse of a specified period of time from the start of the pump down operation, and so that the second solenoid valve 312 through which the refrigerant in gas phase flows in the cooling operation is automatically closed after a lapse of a specified period of time from the start of the pump down operation. Thus the flammable refrigerant can be confined in the outdoor heat exchanger 103 and the compressor 101.

At the end of the pump down operation, additionally, the operation control unit 931 controls the compressor 101 so that the piston 129 stops at the overlapping position where the roller 27 of the piston 129 overlaps the entire discharge hole 51*a* when viewed in the axial direction of the cylinder chamber 122.

Thus the operation control unit 931 controls the compressor 101 so that the roller 27 of the piston 129 stops at the position where the roller 27 totally closes the discharge hole 51*a* and, when the flammable refrigerant is about to flow out through the discharge hole 51*a* after the end of the pump down operation, the roller 27 of the piston 129 resists flow of the flammable refrigerant, so that the flammable refrigerant can be prevented from flowing out through the discharge hole 51*a* or so that an amount of the flammable refrigerant which flows out through the discharge hole 51*a* can be reduced.

Consequently, the flammable refrigerant collected into the outdoor heat exchanger 103 can be suppressed from counterflowing through the discharge hole 51*a* toward the side of the indoor heat exchanger 104 in the refrigerant circuit 100.

Besides, even in case where a malfunction or the like makes it impossible to close the second solenoid valve 312, an amount of the flammable refrigerant which passes through the second solenoid valve 312 can be reduced.

Though the operation control unit 931 controls the compressor 101 so that the piston 129 stops at the overlapping position where the roller 27 of the piston 129 overlaps the entire discharge hole 51*a* when viewed in the axial direction of the cylinder chamber 122, there is no limitation to such an operation. For instance, as illustrated in FIG. 3D, the operation control unit 931 may control the compressor 101 so that the piston 129 stops at the position where the roller 27 of the piston 129 overlaps the portion of the discharge hole 51*a* when viewed in the axial direction of the cylinder chamber 122.

Though the second solenoid valve 312 is provided in the fourth embodiment, the second solenoid valve 312 may be removed and a closure function similar to that of the second solenoid valve 312 may be attained by a positional relationship between the roller 27 and the discharge hole 51*a* in which the discharge hole 51*a* is totally closed by the roller 27 of the piston 129.

In the fourth embodiment, the first and second closing valves 111 and 112 are for the services such as repairing and inspection and therefore may be removed.

Figure 8:
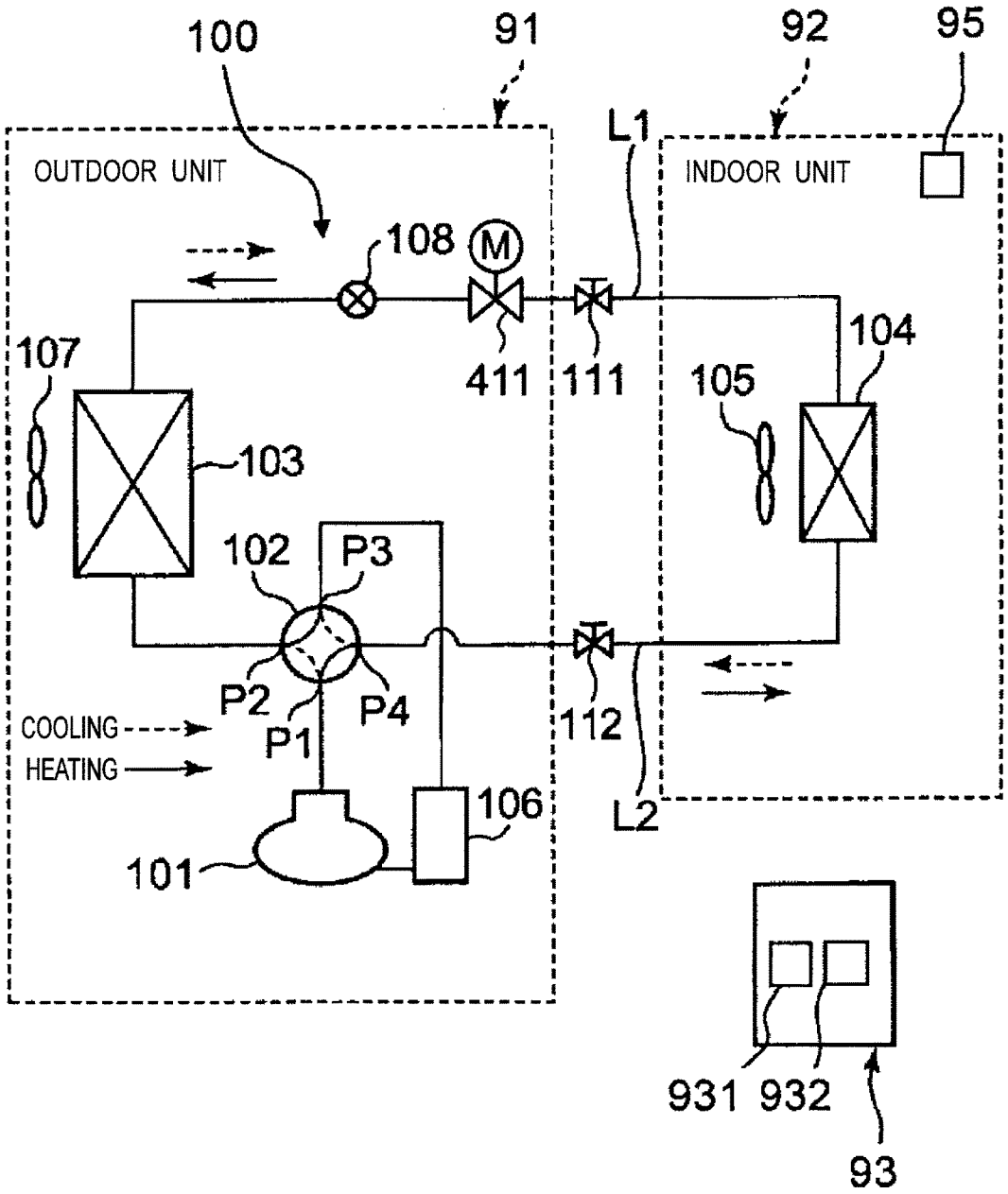
FIG. 8 is a schematic configuration illustrating a modification of the air conditioning machine in accordance with the fourth embodiment of the invention.

Though the first and second solenoid valves 311 and 312 are used as the automatic valves in the fourth embodiment, a totally closable first motor-operated valve 411 may be used as an automatic valve in place of the first solenoid valve 311 of FIG. 7, as in a modification illustrated in FIG. 8, and may be made to serve functions similar to those of the first solenoid valve 311 so that actions and effects similar to those of the fourth embodiment can be attained.

Though the second solenoid valve 312 is removed in the modification illustrated in FIG. 8, a second motor-operated valve that has functions similar to those of the second solenoid valve 312 in FIG. 7 and that is not illustrated may be provided.

Fifth Embodiment

Figure 9:
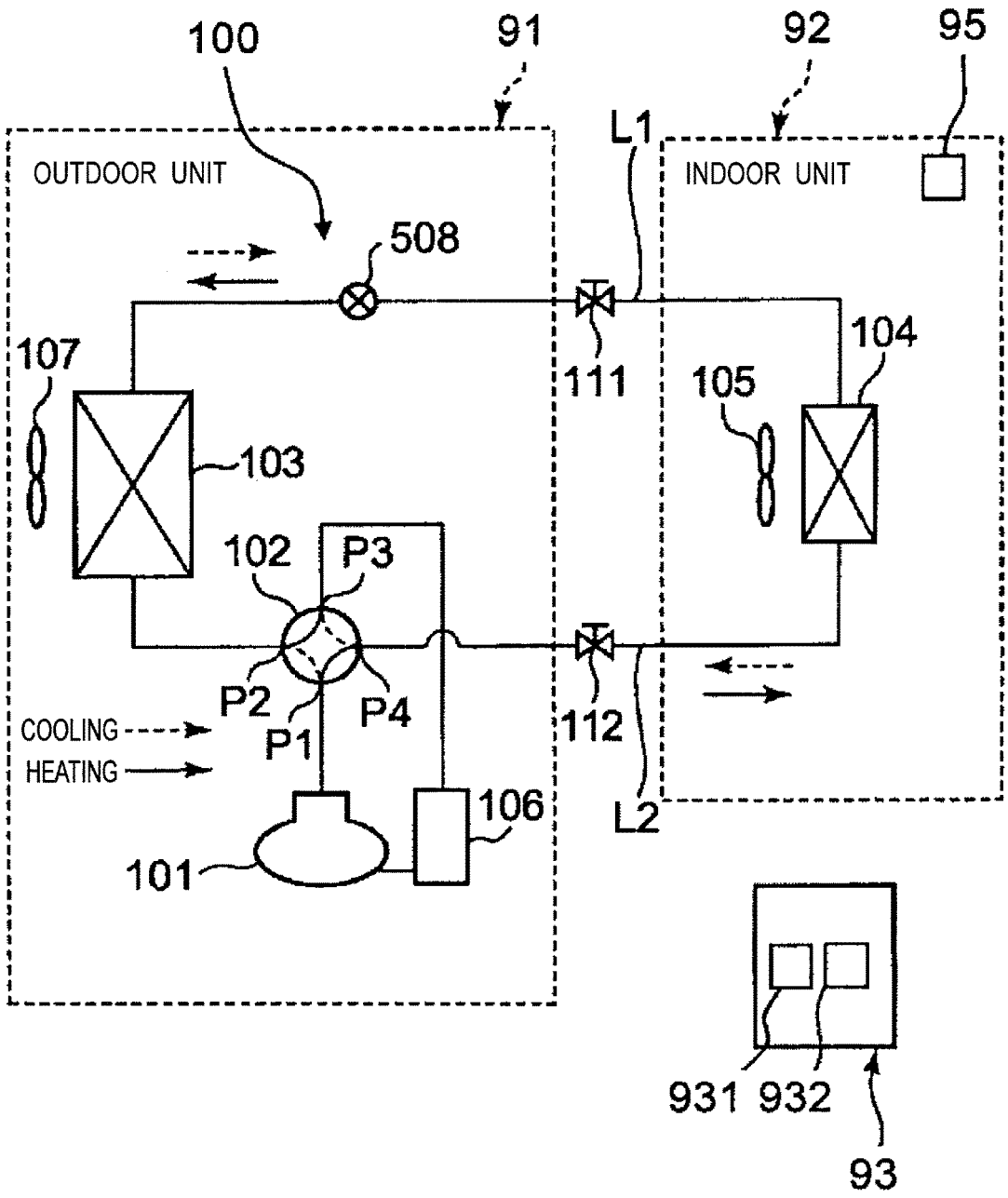
FIG. 9 is a schematic configuration illustrating an air conditioning machine in accordance with a fifth embodiment of the invention.

FIG. 9 is a schematic configuration illustrating an air conditioning machine in accordance with a fifth embodiment of the invention and is different from FIG. 1 for the first embodiment only in that a totally closable motor-operated valve 508 as the pressure reducing mechanism is used in place of the expansion valve 108 in FIG. 1. Therefore, components in FIG. 9 that are the same as the components of the first embodiment illustrated in FIG. 1 are provided with the same reference characters as those for the components in FIG. 1 and different components will be described below with description on configurations and actions of the same components omitted. FIGS. 2 and 3A through 3D for the first embodiment will be reused for the fifth embodiment.

Though the first closing valve 111 is closed after the lapse of the specified period of time from the start of the pump down operation in the first embodiment illustrated in FIG. 1, such a function of the first closing valve 111 is fulfilled by total closure of the totally closable motor-operated valve 508 in the fifth embodiment.

The first closing valve 111 is primarily used on occasions of the services such as repairing and inspection.

When the refrigerant leakage sensing unit 95 senses leakage of the flammable refrigerant from the refrigerant circuit 100 in the air conditioning machine having above configurations, the operation control unit 931 as the pump down operation control unit in the controller 93 carries out the pump down operation mode for accumulating the flammable refrigerant in the outdoor heat exchanger 103 and the compressor 101.

In the pump down operation mode, the compressor 101, the totally closable motor-operated valve 508, and the four-way switching valve 102 are controlled by the operation control unit 931 so that the cooling operation is forcibly started, so that the totally closable motor-operated valve 508 through which the refrigerant in liquid phase flows in the cooling operation is automatically and totally closed after a lapse of a specified period of time from the start of the pump down operation, and so that the second solenoid valve 112 through which the refrigerant in gas phase flows in the cooling operation is closed after a lapse of a specified period of time from the start of the pump down operation. Thus the flammable refrigerant can be confined in the outdoor heat exchanger 103 and the compressor 101.

At the end of the pump down operation, additionally, the operation control unit 931 controls the compressor 101 so that the piston 129 stops at the overlapping position where the roller 27 of the piston 129 overlaps the entire discharge hole 51*a* when viewed in the axial direction of the cylinder chamber 122.

Thus the operation control unit 931 controls the compressor 101 so that the roller 27 of the piston 129 stops at the position where the roller 27 totally closes the discharge hole 51*a* and, when the flammable refrigerant is about to flow out through the discharge hole 51*a* after the end of the pump down operation, the roller 27 of the piston 129 resists flow of the flammable refrigerant, so that the flammable refrigerant can be prevented from flowing out through the discharge hole 51*a* or so that the amount of the flammable refrigerant which flows out through the discharge hole 51*a* can be reduced.

Consequently, the flammable refrigerant collected into the outdoor heat exchanger 103 can be suppressed from counterflowing through the discharge hole 51*a* toward the side of the indoor heat exchanger 104 in the refrigerant circuit 100.

Though the first and second closing valves 111 and 112 are used in the fifth embodiment, the first and second closing valves 111 and 112 may be removed.

As a matter of course, the components described for the first through fifth embodiments and the modification may appropriately be combined and may appropriately be selected, replaced, or deleted.

REFERENCE SIGNS LIST

51*a*, 251*a* discharge hole
95 refrigerant leakage sensing unit
100 refrigerant circuit
101, 201 compressor
102 four-way switching valve
103 outdoor heat exchanger
104 indoor heat exchanger
108 pressure reducing mechanism
111, 112 closing valve
122, 225 cylinder chamber
129, 179 piston
240 movable scroll
311, 312 solenoid valve
411 motor-operated valve
508 fully closable motor-operated valve
931 pump down operation control unit
932 position detection unit

The invention claimed is:

1. An air conditioning machine comprising:

a refrigerant circuit in which a compressor, a four-way switching valve, an indoor heat exchanger, an expansion valve, and an outdoor heat exchanger are circularly connected;

a refrigerant leakage sensor that senses leakage of a flammable refrigerant from the refrigerant circuit; and a controller that carries out a heating operation mode, a cooling operation mode, and a pump down operation mode, wherein the compressor includes a cylinder chamber;

a compression member that is placed in the cylinder chamber and that compresses the flammable refrigerant; and a discharge hole through which the flammable refrigerant compressed in the cylinder chamber is discharged, and the controller is configured to, when a flammable refrigerant leak is sensed, automatically switch to the pump down operation mode such that the flammable refrigerant is accumulated in the outdoor heat exchanger by forcibly starting a cooling operation;

automatically closing, after lapse of a predefined period of time, a liquid side valve through which the flammable refrigerant in a liquid phase flows;

automatically closing, after lapse of a second predefined period of time, a gas side value through which the flammable refrigerant in a gas phase flows; and controlling the compressor so that the compression member stops at a position where the compression member overlaps at least a portion of the discharge hole when viewed in an axial direction of the cylinder chamber, at an end of the pump down operation.

2. The air conditioning machine as claimed in claim 1, further comprising a position detector detecting a position of the compression member in the cylinder chamber.

3. The air conditioning machine as claimed in claim 1, wherein liquid side valve is connected between the indoor heat exchanger and the expansion valve.

4. The air conditioning machine as claimed in claim 3, wherein the liquid side valve is an automatic valve.

5. The air conditioning machine as claimed in claim 4, wherein the automatic valve is a solenoid valve or a motor-operated valve.

6. The air conditioning machine as claimed in claim 1, wherein the expansion valve is a fully closable motor-operated valve.

7. The air conditioning machine as claimed in claim 1, wherein the controller controls the compressor so that the compression member stops at a position where the compression member entirely overlaps the discharge hole when viewed in an axial direction of the cylinder chamber, at an end of the pump down operation.

* * * * *